US010957996B2

(12) United States Patent
Truong et al.

(10) Patent No.: US 10,957,996 B2
(45) Date of Patent: Mar. 23, 2021

(54) CONNECTOR MADE OF AN ELECTRICALLY INSULATING MATERIAL TO ELECTRICALLY CONNECT A MAIN CONDUCTOR AND A SECONDARY CONDUCTOR

(71) Applicant: COMMISSARIAT A L'ENERGIE ATOMIQUE ET AUX ENERGIES ALTERNATIVES, Paris (FR)

(72) Inventors: Bruno Truong, Grenoble (FR); Ghislain Despesse, Grenoble (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 0 days.

(21) Appl. No.: 16/590,034

(22) Filed: Oct. 1, 2019

(65) Prior Publication Data

US 2020/0106199 A1 Apr. 2, 2020

(30) Foreign Application Priority Data

Oct. 2, 2018 (FR) ..... 18 59131

(51) Int. Cl.
*H01R 11/09* (2006.01)
*H01R 11/07* (2006.01)
(Continued)

(52) U.S. Cl.
CPC ..... *H01R 11/07* (2013.01); *H01R 4/2408* (2013.01); *H01R 4/48* (2013.01); *H01R 11/01* (2013.01); *H01R 43/01* (2013.01)

(58) Field of Classification Search
CPC ..... H01R 4/48; H01R 4/2408; H01R 43/01; H01R 11/01; H01R 11/07
(Continued)

(56) References Cited

U.S. PATENT DOCUMENTS 3,235,944 A * 2/1966 Broske ..... H01R 4/5083 29/872
3,708,779 A * 1/1973 Enright ..... H01R 4/2429 439/392
(Continued)

FOREIGN PATENT DOCUMENTS

CN 201750032 U 2/2011
CN 106 058 504 A 10/2016
(Continued)

OTHER PUBLICATIONS

U.S. Appl. No. 16/041,142, filed Jul. 20, 2018, Despesse, G., et al.
(Continued)

*Primary Examiner* — Abdullah A Riyami
*Assistant Examiner* — Vladimir Imas
(74) *Attorney, Agent, or Firm* — Oblon, McClelland, Maier & Neustadt, L.L.P.

(57) ABSTRACT

A connector made of an electrically insulating material that will electrically connect a main conductor and a secondary conductor, the connector including a central section extending along a longitudinal direction, a main part and a secondary part defining a main channel and a secondary channel respectively, parallel to the longitudinal direction and separated by the central section, the connector also includes electrical connection devices made of an electrically conducting material, designed to electrically connect the main conductor and the secondary conductor as soon as they are inserted in the main channel and in the secondary channel respectively.

22 Claims, 14 Drawing Sheets

(51) Int. Cl.

| | |
|---|---|
| ***H01R 4/2408*** | (2018.01) |
| ***H01R 4/48*** | (2006.01) |
| ***H01R 11/01*** | (2006.01) |
| ***H01R 43/01*** | (2006.01) |

(58) Field of Classification Search
USPC ..... 439/796
See application file for complete search history.

(56) References Cited

U.S. PATENT DOCUMENTS

| | | | | | |
|---|---|---|---|---|---|
| 4,857,020 | A * | 8/1989 | Crosby | H01R 4/5091 | 439/783 |
| 4,943,246 | A * | 7/1990 | Gilbert | H01R 13/652 | 439/577 |
| 5,015,198 | A | 5/1991 | Delin | | |
| 5,021,611 | A * | 6/1991 | Amano | H01R 4/70 | 156/49 |
| 5,092,797 | A * | 3/1992 | Cole | H01R 4/5091 | 411/2 |
| 5,301,422 | A * | 4/1994 | Uzelac | H01R 4/46 | 29/755 |
| 5,580,284 | A * | 12/1996 | Laricchia | H01R 4/5091 | 439/783 |
| 7,494,385 | B2 * | 2/2009 | Copper | H01R 4/5091 | 439/770 |
| 7,789,718 | B2 * | 9/2010 | Desard | H01R 4/36 | 439/276 |
| 7,803,007 | B1 * | 9/2010 | Chou | H01R 4/4818 | 439/441 |
| 7,819,706 | B2 * | 10/2010 | Copper | H01R 4/5083 | 439/783 |
| 8,402,641 | B2 * | 3/2013 | Johnson | H01R 4/5083 | 29/745 |
| 9,954,305 | B2 * | 4/2018 | Yu | H01R 13/424 | |
| 10,547,124 | B2 * | 1/2020 | Robicheau | H01R 4/186 | |
| 2008/0287010 | A1 * | 11/2008 | Copper | H01R 4/5091 | 439/783 |

FOREIGN PATENT DOCUMENTS

| | | | |
|---|---|---|---|
| CN | 107086378 | A | 8/2017 |
| CN | 107863616 | A | 3/2018 |
| CN | 207233964 | U | 4/2018 |
| CN | 108075243 | A | 5/2018 |
| DE | 41 20 732 | A1 | 1/1992 |
| DE | 197 57 862 | A1 | 11/1998 |
| DE | 198 56 568 | A1 | 8/1999 |
| EP | 0 340 075 | A1 | 11/1989 |
| EP | 0 533 563 | A1 | 3/1993 |
| EP | 0 977 310 | A2 | 2/2000 |
| JP | 50-138580 | | 11/1975 |
| JP | 50-147873 | | 11/1975 |
| JP | 51-18871 | | 2/1976 |
| JP | 64-1425 | B2 | 1/1989 |
| JP | 2005-332603 | A | 12/2005 |

OTHER PUBLICATIONS

French Preliminary Search Report dated May 27, 2019 in French Application 18 59131 filed on Oct. 2, 2018 (with English Translation of Categories of Cited Documents).

* cited by examiner

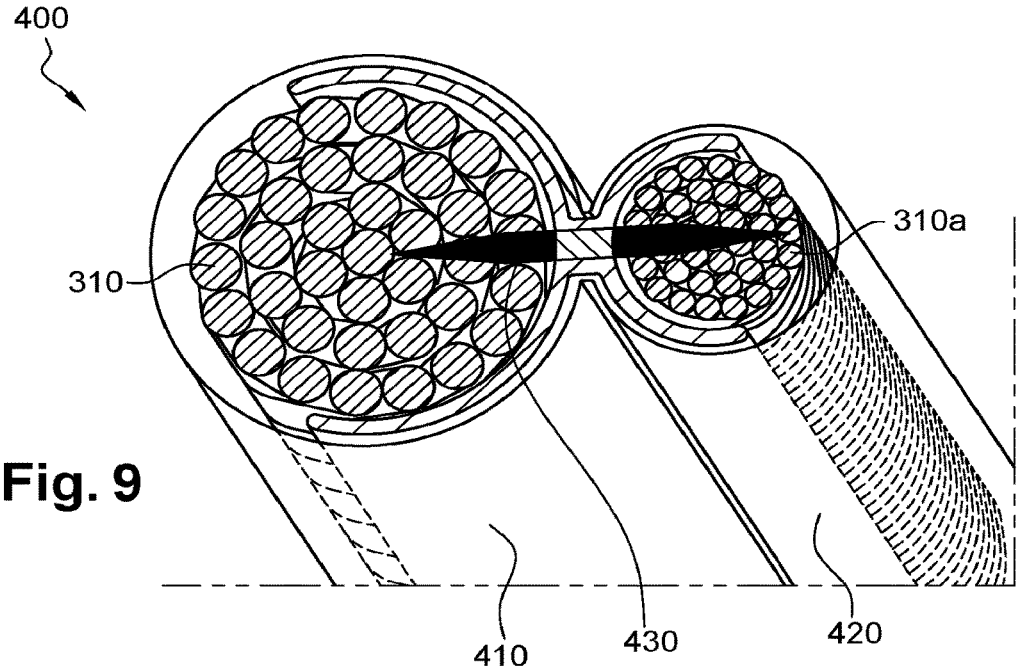
Fig. 9
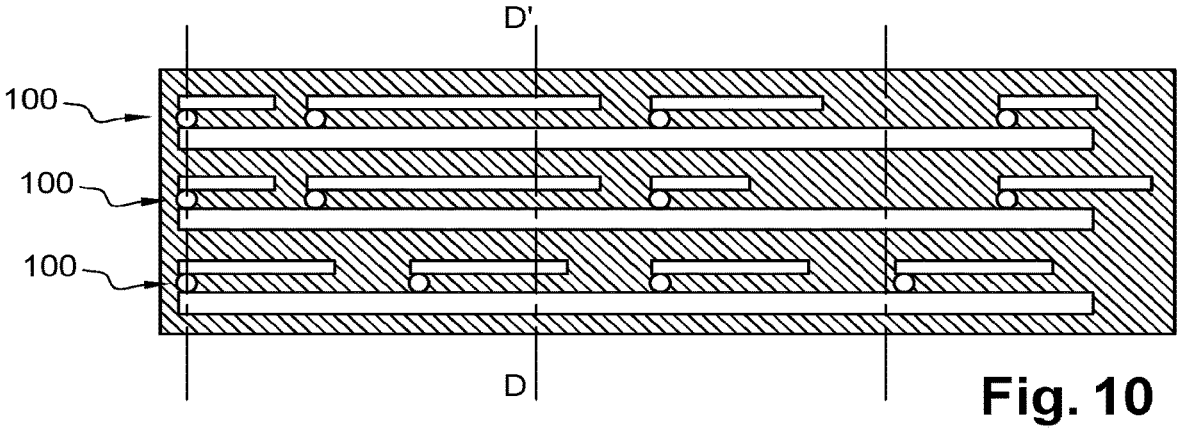
Fig. 10
Fig. 11a
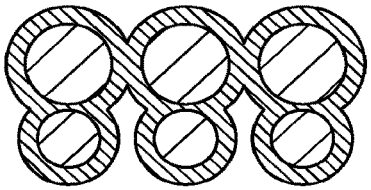
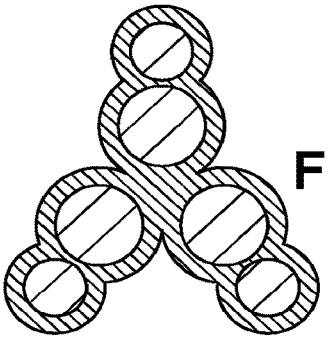
Fig. 11b

CONNECTOR MADE OF AN ELECTRICALLY INSULATING MATERIAL TO ELECTRICALLY CONNECT A MAIN CONDUCTOR AND A SECONDARY CONDUCTOR

TECHNICAL FIELD

This invention relates to a connector designed to electrically connect a main conductor and a secondary conductor.

In particular, this invention relates to a connector capable of facilitating the electrical connection in parallel of electrical equipment to a main cable through a plurality of secondary cables.

In particular, the connector according to this invention can be used in a multi-conductor electrical cable provided with a main cable, comprising a main conductor to which stub cables, each comprising a secondary conductor, are electrically connected through connectors. In this respect, the stub cables and the main cable comprise a common sheath arranged to hold said stub cables fixed to the main cable over their entire length, and also arranged such that stub cables can be detached while maintaining the electrical insulation of these cables and their electrical connection to the main cable.

STATE OF PRIOR ART

The electrical connection of a large number of equipment items, particularly in parallel, generally requires the use of a wiring network capable of electrically connecting each of said equipment items to an electrical source.

Wiring networks making use of a terminal block are predominant among solutions known in prior art.

In this respect, FIG. 1 illustrates a wiring network 1 with a plurality of electrical cables 2 connected to a terminal block 3.

However, such a wiring network is not satisfactory.

The electrical connection of all electric cables 2 to the terminal block 3 requires a number of manual operations during installation of the wiring network. These manual operations, often done in a congested environment, are complicated in practice.

Furthermore, the wiring network 1 is not sealed at the terminal block 3.

Alternatively, the wiring network 1 can make use of male-female connectors so as to form stubs from a main cable.

The use of such a wiring network 1 is also not satisfactory.

Placement of connectors requires cutting the main cable and crimping a male-female connector system on each side of the section of said main cable, for example using a plier. In particular, the male female connector system is provided with a stub to which a secondary cable can be connected.

The installation of such a wiring network also requires a number of manual steps, often in congested locations, that correspondingly increases the costs of implementing it.

Also, when prefabrication of the wiring network is envisaged for a future installation, the stub starting points have to be positioned on the main cable.

A more standard approach is disclosed in document [1] mentioned at the end of the description. In particular, this document discloses a wiring network in the form of a prefabricated harness, the principle of which is shown in FIG. 2. In particular, the wiring network comprises a main cable from which secondary cables extend, themselves being provided with a plurality of secondary cables. An insulating sheath protects the main conductor and the secondary conductors, while electrical connection points between the main conductor and the secondary conductors are reinforced by an insert moulded joint.

However, this approach is also not satisfactory.

Such a harness is generally prefabricated, and if it is tailor made, requires that the exact path that it follows leading to the various electrical equipment in the final installation has to be known in advance.

If it is not tailor made, this type of harness is still complicated to install. In particular, all secondary cables are points that can get caught and can make it more difficult to pull the harness in an installation.

Furthermore, fabrication of this type of harness requires a large number of process steps, and particularly manual steps.

Furthermore, ends of unused secondary cable are not electrically insulated.

One purpose of this invention is then to disclose a connector by which a wiring network can be made more easily than known wiring networks in prior art.

Another purpose of this invention is to disclose a connector for making an electrical connection of secondary conductors to a main conductor without cutting the main conductor.

PRESENTATION OF THE INVENTION

The purposes of this invention are at least partly satisfied by a connector made of an electrically insulating material that will electrically connect a main conductor and a secondary conductor, the connector comprising a connection device that comprises:

a central section extending along a longitudinal direction;

a main part and a secondary part defining a main channel and a secondary channel respectively, parallel to the longitudinal direction and separated by the central section, the connector comprises electrical connection means made of an electrically conducting material, designed to electrically connect the main conductor and the secondary conductor as soon as they are inserted in the main channel and in the secondary channel respectively.

According to one embodiment, the electrical connection means comprise a main contact section and a secondary contact section emerging in the main channel and in the secondary channel respectively, and connected by an intermediate section.

According to one embodiment, the intermediate section passes through the central section at a passage communicating between the main channel and the secondary channel.

According to one embodiment, the communicating passage is also open at one end of the central section to enable assembly of electrical connection means and the connecting element, by sliding along the longitudinal direction.

According to one embodiment, each of the main contact section and the secondary contact section forms an elongated or tenon shaped or pointed protuberance.

According to one embodiment, the main contact section and/or the secondary contact section have shapes complementary to the surface defining the main channel, and the surface defining the secondary channel, respectively.

According to one embodiment, the intermediate section comprises a clip that performs the function of holding the electrical connection means at the central section.

According to one embodiment, the electrical connection means comprise a screw, particularly a setscrew.

According to one embodiment, the connection element comprises a drilling at the central section arranged such that the screw thread opens up in the main channel and the secondary channel, and is used to tighten the main conductor and the secondary conductor respectively.

According to one embodiment, the main channel and/or the secondary channel comprise(s) a lateral slit over its entire length.

According to one embodiment, the secondary channel comprises a stop called the secondary stop that will prevent a secondary conductor from passing through the secondary channel completely.

According to one embodiment, the secondary stop separates the volume of the secondary channel into a first volume and a second volume.

According to one embodiment, the secondary contact section emerges only in one or the other of the first and second volumes.

According to one embodiment, the secondary part is tubular in shape and comprises a contraction zone forming the secondary stop.

According to one embodiment, the main part is tubular in shape.

According to one embodiment, the secondary channel is provided with anchor means designed to hold the secondary conductor in a locked position.

According to one embodiment, the anchor means comprise projecting elements that will grip the secondary conductor.

According to one embodiment, the connecting element is a single-piece.

According to one embodiment, the connecting element is an assembly of an upper section and a lower section called the upper central section and the lower central section respectively, and assembled at their central sections.

According to one embodiment, the upper section and the lower section are essentially symmetric to each other about a plane containing the elongation axes of the main channel and the secondary channel.

According to one embodiment, the connection means include a fuse function.

The invention also relates to a multi-conductor electrical cable extending along a length, called the principal length Lp, and including:

a main cable extending over the principal length Lp, and stub cables distributed along the main cable, the main cable comprises a main conductor, encased by an encasing sheath, each stub cable comprises a secondary conductor embedded in the encasing sheath and held fixed to and parallel to the main cable, each secondary conductor is provided with a contact segment connected to the main conductor and a stub segment, the stub segment being insulated from the main conductor by a section called the insulating section of the encasing sheath, the electric connection between the main conductor and the contact segment being made by means of a connector according to this invention.

The invention also relates to a multi-conductor electrical cable extending along a length, called the principal length Lp, and including:

a main cable extending over the principal length Lp, and stub cables distributed along the main cable, the main cable comprises a main conductor, and is encased by an encasing sheath, each stub cable comprises a secondary conductor embedded in the encasing sheath and held fixed to and advantageously parallel to the main cable, along its entire length, each secondary conductor is provided with a contact segment connected to the main conductor and a stub segment, the stub segment being insulated from the main conductor by a section called the insulating sector of the encasing sheath.

According to one embodiment, for each connection cable, the insulation section is adapted to be partly cut, advantageously along the extension length of the cable, so as to release a portion of said stub cable while maintaining the insulation by the encasing sheath of the stub cable considered.

According to one embodiment, the insulation section includes a zone of mechanical weakness adapted to enable cutting by tearing, the insulation section advantageously comprises a thinned part in the zone of mechanical weakness.

According to one embodiment, each stub cable comprises a termination without a secondary conductor along its prolongation, advantageously the cut in the insulation section is initiated when a tearing force is applied on the termination.

According to one embodiment, the termination is located in the prolongation of the stub segment.

According to one embodiment, for each secondary conductor, the contact segment is at one end of the secondary conductor considered.

According to one embodiment, the stub cables are uniformly distributed along the length of the main cable.

According to one embodiment, the stub cables all have the same length.

According to one embodiment, the stub cables form at least one row of stub cables arranged in continuity with each other.

According to one embodiment, each secondary conductor comprises an electrically conducting core around which a conducting material is arranged extending along the length of the secondary conductor, advantageously the conducting material comprises conductors braided or twisted around the core.

According to one embodiment, the secondary conductors of the stub cables are arranged in a row and comprise a common core, advantageously the common core will be cut when a stub cable is detached, and even more advantageously the common core is designed to be cut when said cable is detached along the prolongation of the secondary conductor of the stub cable considered.

According to one embodiment, the contact between a contact segment and the main conductor is a direct contact.

According to one embodiment, the direct contact is obtained by tightening the contact segment adjacent to the main conductor, or by contact between the metal strands emerging from the contact segment and from the main conductor, by fusion between the contact segment and the main conductor.

According to one embodiment, the contact between a contact segment and the main conductor is an indirect contact.

According to one embodiment, the contact between the contact segment and the main conductor is made through a part called the contact part.

According to one embodiment, the electrically conducting contact part is a metal strip encasing the contact segment and the main conductor at said contact segment.

According to one embodiment, the contact part comprises a connector, designed to electrically connect the main conductor and the contact segment, the connector comprising a connection element that comprises:

a central section extending along a longitudinal direction;

a main part and a secondary part defining a main channel and a secondary channel respectively, parallel to the longitudinal direction and separated by the central section.

According to one embodiment, the connector comprises connection means made of an electrically conducting material, designed to electrically connect the main conductor and the contact segment as soon as they are inserted in the main channel and the secondary channel respectively.

According to one embodiment, the connection element is made from an electrically conducting material.

According to one embodiment, the connection element is made from an electrically insulating material.

The invention also relates to an assembly comprising a plurality of multi-conductor electrical cables according to this invention, arranged parallel to each other, the encasing sheath being common to each of the multi-conductor electrical cables.

Note that the main conductor and/or the secondary conductor may be formed from a multi-strand conductor, the strands for example being parallel, twisted or braided. The section of the conductors or the strands may be round, oval, rectangular, square or other.

BRIEF DESCRIPTION OF THE DRAWINGS

Other characteristics and advantages will become clear in the following description of a connector, given as non-limitative examples, with reference to the appended drawings in which:

FIG. 9 is a second example of an indirect contact via a contact part between a secondary conductor and the main conductor of a cable according to this invention, FIG. 10 is a diagrammatic representation of an assembly of a plurality of multi-conductor electrical cables according to this invention, FIGS. 11*a* and 11*b* are views on the section plane DD' in FIG. 10;

FIGS. 12*a* and 12*b* represent particularly the connector with and without electrical connection means, respectively;

FIG. 15*a* represents electrical connection means alone, and FIG. 15*b* represents the connector assembled with the electrical connection means in FIG. 15*a;*

FIGS. 17*a* to 17*c* represent in particular several alternative secondary stops;

DETAILED PRESENTATION OF PARTICULAR EMBODIMENTS

This invention relates to a connector provided with two parallel channels called the main channel and the secondary channel respectively, and separated by a central section. In particular, the connector is designed to connect a main conductor and a secondary conductor. In this respect, the connector can also be provided with electrical connection means making electrical contact between said wires as soon as the wires are inserted into the main and the secondary channels.

The connector is advantageously used in a multi-conductor electrical cable. In particular, the multi-conductor electrical cable is provided with a main conductor extending over the entire length of said cable, and a plurality of secondary conductors, for example connected at one end to the main conductor and that will form branches of said main conductor. The assembly composed of the main conductor and the secondary conductors is coated with an encasing sheath to form a main cable with the main conductor, and stub cables with the secondary conductors, respectively.

The insulating sheath is arranged to hold the stub cables over their entire length, fixed to the main cable and also to be cut so as to release the stub cables while keeping the insulating sheath around the main and secondary conductors.

The invention will now be described in detail with reference to FIGS. 3*a* to 9.

For the purposes of this invention, "cable" refers to a plurality of electrical conductors combined in a protective sheath. However, a cable according to this invention must also include one electric wire.

Figure 1:
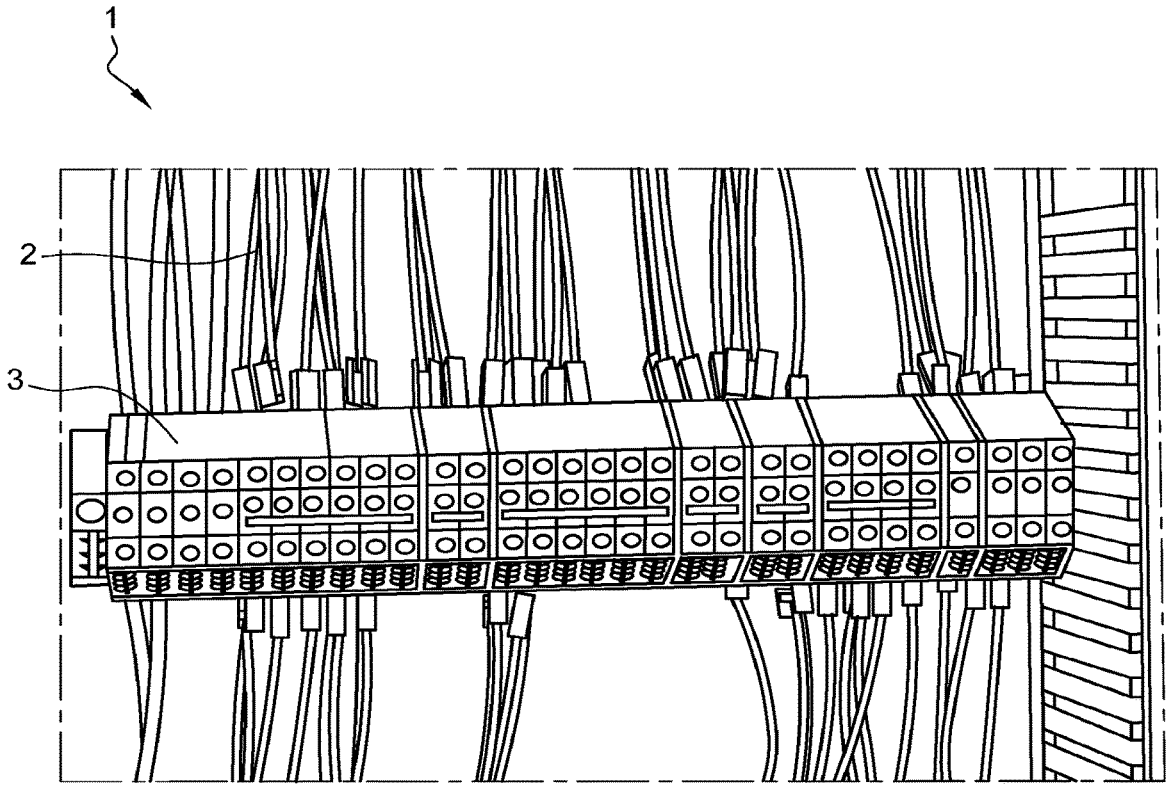
FIG. 1 is a close up view of a terminal block known in prior art, and used in a wiring network connecting a plurality of electrical conductors.
Figure 2:
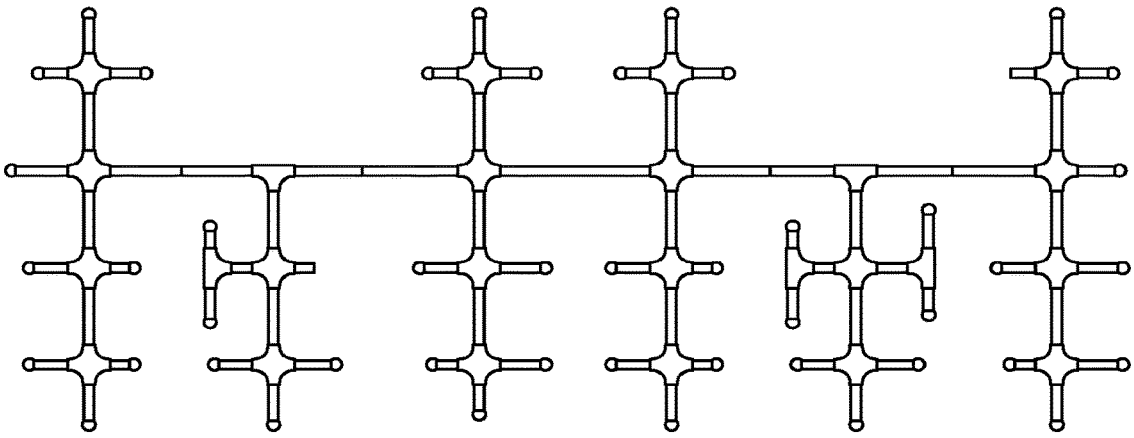
FIG. 2 is a diagrammatic representation of a harness known in prior art and described in document [1] and mentioned at the end of the description.
Figure 3A:
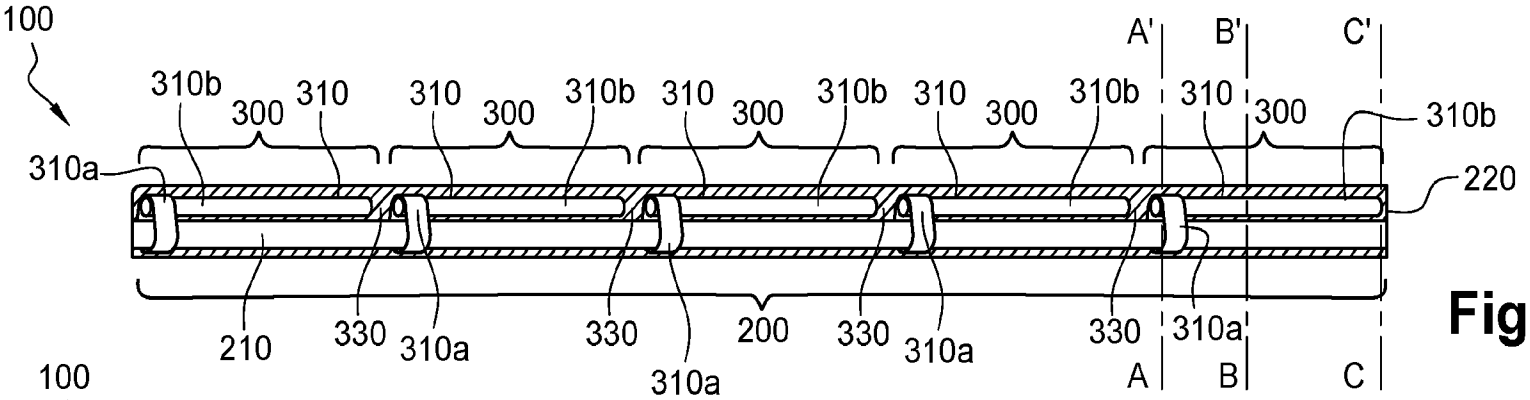
FIG. 3*a* is a diagrammatic representation showing a section plane of a multi-conductor electrical cable extended along its elongation axis, according to one embodiment of the invention.
Figure 3B:
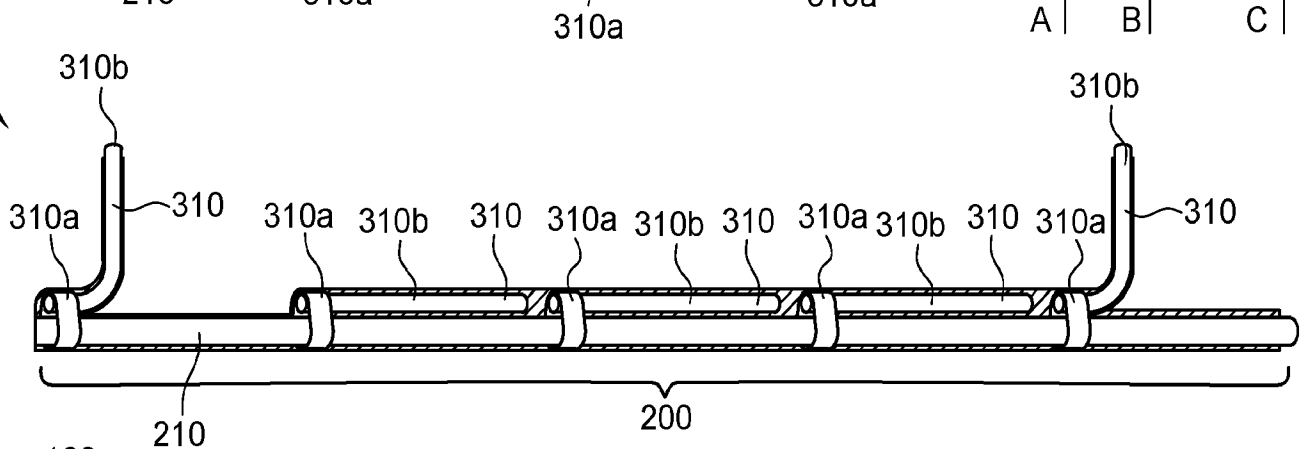
FIG. 3*b* shows the cable in FIG. 3*a* with the same section plane, however the cable having two partially detached stub cables.
Figure 4:
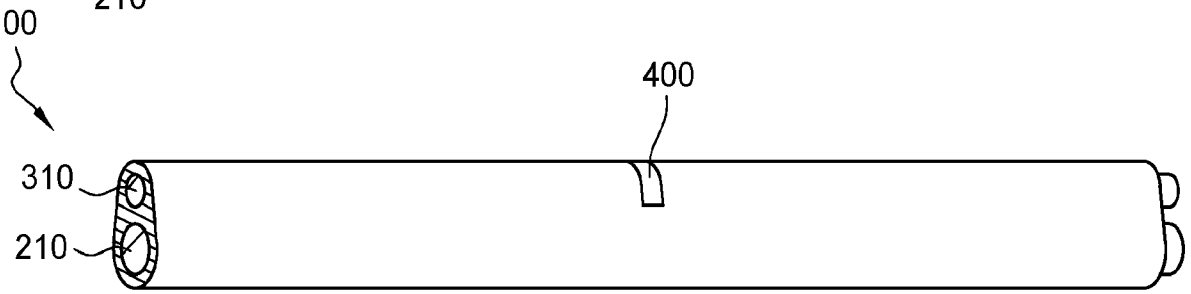
FIG. 4 is a diagrammatic representation of the cable according to this invention provided with marking.

FIG. 3*a* represents a multi-conductor electric cable 100 according to this invention.

The cable 100 according to this invention, extends over a length called the principal length Lp. The principal length Lp may be between several metres and several tens of metres or even several kilometres.

The cable 100 comprises particularly a main conductor 210 coated by an encasing sheath 220 and forming a main cable 200 with this sheath.

The main cable 200 extends over the entire principal length Lp. It is understood, without it being necessary to specifically state it, that the main conductor 210 also extends along the principal length Lp.

The main conductor 210 may comprise a metal core, the section of which depends on the target application and/or the current intensity that it will be required to transport.

The main conductor 210 may comprise several conductors that may be parallel, twisted, braided, etc.

In particular, the main conductor 210 may contain copper and/or aluminium.

The cable 100 according to this invention also comprises stub cables 300.

Each stub cable 300 comprises particularly a secondary conductor 310 embedded in the encasing sheath 220.

The secondary conductor 310 may contain copper and/or aluminium.

More particularly, the secondary conductor 310 can be held fixed to the main cable 200 over its entire length.

Furthermore, the secondary conductors can be held parallel to the main cable 200 or can be twisted along and around the main cable 200.

In other words, the cable 100 comprises an encasing sheath 220, generally with an elongated shape, and encasing a main conductor 210 and a plurality of secondary conductors 310, for example arranged parallel to the main conductor 210.

Furthermore, the encasing sheath 220 is in intimate contact with the secondary conductors 310 and the main conductor 210. More particularly, the space that could be present between the secondary conductors 310 and the encasing sheath 220 is at least 5 times less than, or even 20 times less than, the volume of said secondary conductors 310.

Equivalently, the space that could be present between the main conductor 210 and the encasing sheath 220 is a least 5 times less than, or even 20 times less than, the volume of said main conductor.

The secondary conductor 310 and the main conductor 210 may each comprise a different material. In particular, the main conductor 210 may include a metal with very low resistivity (for example copper) so that it can transport a large quantity of current, and the secondary conductors can be made of aluminium.

Conversely, the main conductor 210 can be made of aluminium so as to reduce the global mass of the cable, and the secondary conductors 310 can be made of copper so as to facilitate the electrical connection of stub cables to electrical equipment.

The assembly comprising the encasing sheath 220, the main conductor 210 and the secondary conductors 310 is flexible, without any branches and is electrically insulated from the external environment. In other words, regardless of the considered arrangement of stub cables relative to the main cable, the multi-conductor electrical cable 100 according to his invention is more compact than known harnesses in prior art.

Furthermore, the multi-conductor electrical cable 100 according to this invention has an essentially constant section along the entire length of said cable.

The "cable section" is defined as the intersection of said cable with a plane perpendicular to its direction of elongation.

Also according to this invention, each secondary conductor 310 is provided with a contact segment 310*a* and at least one stub segment 310*b*.

For example, the contact segment 310*a* is at one end of the secondary conductor 310.

The stub cables 300 can be uniformly distributed along the main cable 200.

All stub cables 300 can have the same length.

In this respect, the length of the stub cables 300 may be of the order of between about ten centimetres (for example 10 cm) and several metres (for example 10 m).

It is understood that the length of the stub cables 300 is less than the length of the main cable 200.

The contact segment 310*a* is connected to the main conductor 210. The stub segment 310*b* is insulated from the main conductor 210 by a section, called the insulation section, of the encasing sheath 220. In other words, a section of the encasing sheath is interposed between each stub segment 310*b* and the main conductor 210.

Each of the stub cables 300 may be at least partly detached from the cable 100 while maintaining the electrical insulation of the entire cable 100. In other words, a partially detached stub cable 300 forms a stub from the cable 100 that could be used for the electrical connection of equipment to said cable 100.

It is understood that a stub cable is only detached on a section of the cable comprising the stub segment 310*b* so as to maintain the electrical connection between the contact segment 310*a* and the main conductor 210.

In this respect, for each stub cable 300, the insulation section 100 can be adapted so that it can be partly cut, along the extension length of the cable 100, so as to release a portion of said stub cable while maintaining the insulation by the encasing sheath of the stub cable considered.

In particular, the insulation section 110 can include a zone of mechanical weakness (FIG. 5*b*) adapted to enable cutting by tearing.

Figure 5A:
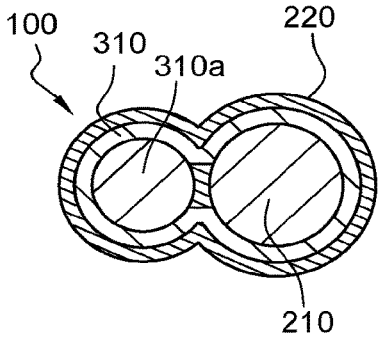
FIGS. 5*a* to 5*c* show diagrammatic representations of a cable according to this invention, on section planes AA', BB' and CC' on FIG. 3*a*.
Figure 5B:
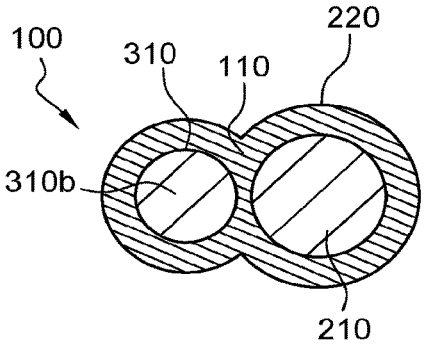
Figure 5C:
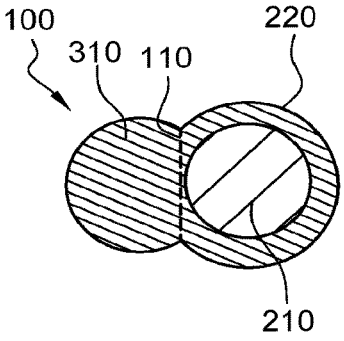
Figure 6:
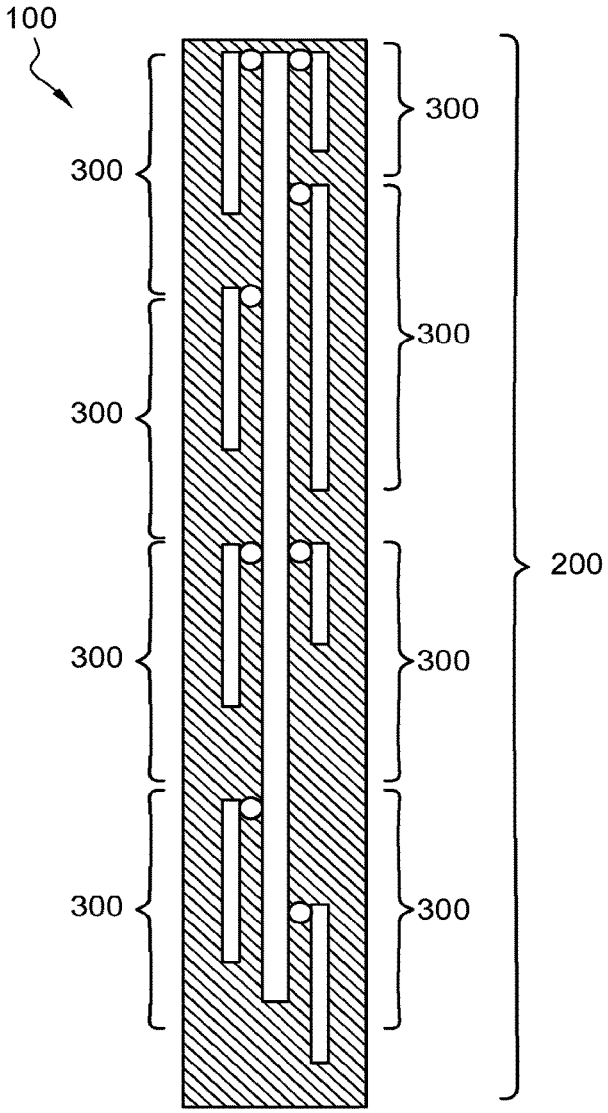
FIG. 6 is a diagrammatic representation of a cable according to this invention, the cable comprising two rows of stub cables, the cable being represented in a section plane containing the elongation direction of the stub and main cables.

"Zone of mechanical weakness" means a zone that breaks first when a force is applied on the insulation section. The zone of mechanical weakness can advantageously be placed at half the distance between the stub segment 310*b* and the main conductor 210. Also advantageously, the zone of mechanical weakness may include a thinned part along a cut line of the insulation section (FIGS. 5*b* and 5*c*).

Complementarily, each stub cable 300 can include a termination 330 in its prolongation (FIG. 3*a*), without a secondary conductor. In other words, each termination 330 is arranged in the prolongation of a stub segment 310*b*.

This termination 330 is particularly advantageous because, for example, it can act as a section in which a cut is initiated by tearing.

Furthermore, the termination 330 of a stub cable 300, as soon as it is at least partially detached, guarantees electrical insulation of said cable.

The outside surface of the encasing sheath can also comprise marking 400 to identify terminations 330 of each of the stub cables 300. The marking 400 may for example be a paint mark or a difference in colour of the encasing sheath. Alternatively or complementarily to the marking, the terminations 330 can be preweakened so as to facilitate detachment of the stub cables 300 starting from said terminations 330. Preweakening may be in the form of a notch or many notches (preweakening by intermittent perforations), formed in the encasing sheath at each termination 330.

Figure 23:
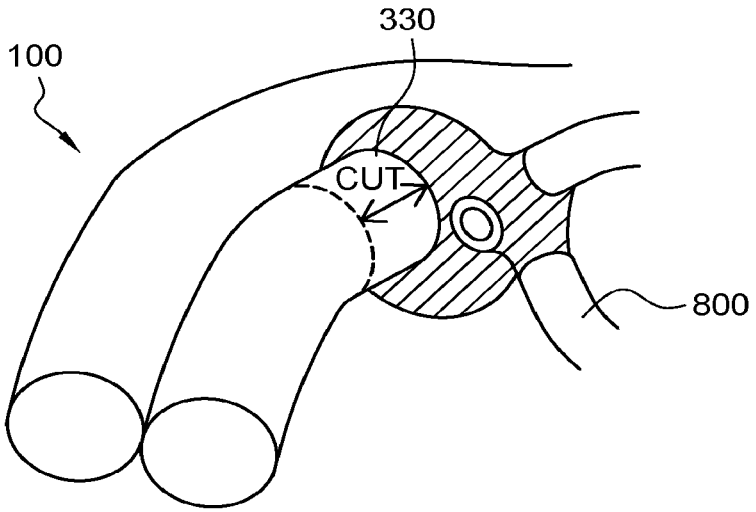

A stub cable can also be detached at its termination 330 using a pair of cutters 800 (FIG. 23).

Advantageously, the length of the stub cables 300 can be at least twenty times more than the diameter of the stub segment. This dimension provides the stub cables with a flexibility that facilitates their reorientation and/or their positioning ready for their electrical connection to a piece of equipment.

According to one particularly advantageous embodiment, the stub cables 300 form at least one row of stub cables, for example two rows (FIG. 6), arranged in continuity with each other.

This method is particularly advantageous because it facilitates fabrication of the cable by an extrusion process.

Complementarily, the secondary conductors 310 can include an electrically insulating core around which a conducting material is arranged extending along the length of the secondary conductor.

In particular, the electrically insulating core may comprise a fibrous material, and particularly carbon fibre.

The electrically insulating core is particularly advantageous because it can reinforce the mechanical strength of the cable.

The conducting material arranged around the core may comprise braided or twisted conductors.

Also advantageously, the secondary conductors 310 of the stub cables 300 arranged in a row comprise a common core.

This core common to the secondary conductors 310 can improve the mechanical strength, particularly the tensile mechanical strength, of the cable.

Initiation of the detachment of a stub cable 300 at its termination may require that the common core is cut at said termination 330, particular with a pair of cutters 800 (FIG. 23).

Consideration of a common core can also facilitate co-extrusion of secondary conductors 310, the main conductor 210 and the encasing sheath 220.

Alternatively, a spacer can be placed in the prolongation of each of the secondary conductors 310, and particularly secondary conductors 310 in a particular row of stub cables 300.

The diameter of the spacers may be equivalent to the secondary conductors 310 that they prolong.

In particular, the spacers may be in contact with the ends of the two adjacent secondary conductors 310.

The spacers may comprise kevlar.

The contact between a contact segment 310*a* and the main conductor 210 may be a direct contact.

"Direct contact" means a contact without the use of an intermediate element.

Figure 7A:
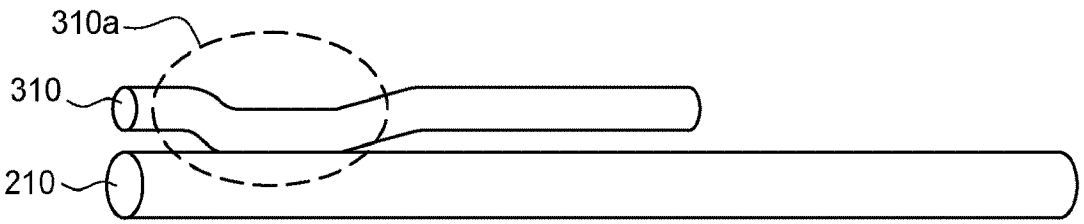
FIGS. 7*a* to 7*c* are diagrammatic representations of direct contacts between a secondary conductor and the main conductor of a cable according to this invention.
Figure 7B:
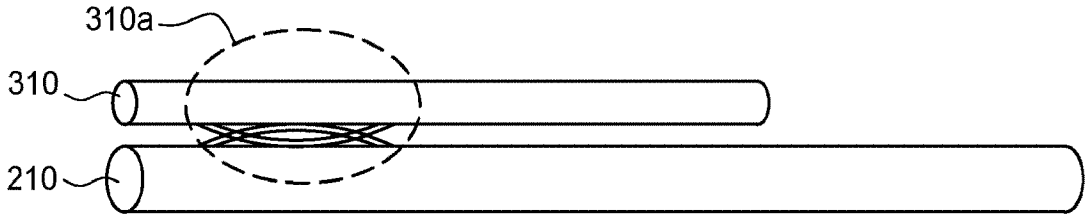
Figure 7C:
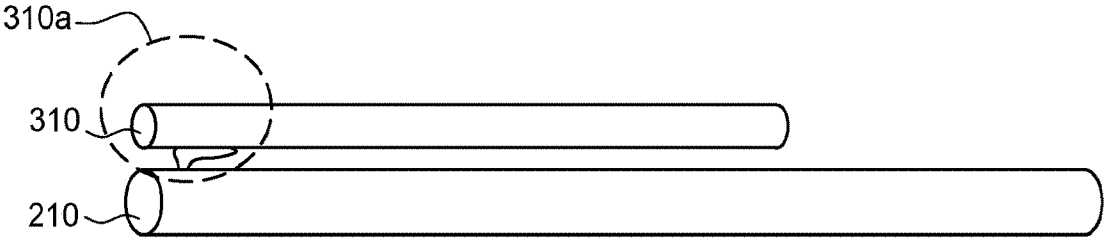

Advantageously, the direct contact may be obtained by tightening the contact segment between the main conductor (FIG. 7*a*), or by contact between metal wire strands emerging from the contact segment and from the main conductor (FIG. 7*b*), by fusion between the contact segment and the main conductor (FIG. 7*c*).

Alternatively, the contact between the contact segment 310*a* and the main conductor 210 is made through a part called the contact part 400.

For example, the contact part may at least partially surround the main conductor 210 and the contact segment 310*a*.

The use of such a contact part 400 can reinforce the cable 100 at the contact between the secondary conductors 310 and the main conductor 210. Thus, this reinforcement provides greater resistance to tearing when a stub cable is detached, and thus protects the insulation after partial detachment of a stub cable 300.

The contact part 400 may for example by an electrically conducting part squeezing a stub cable 300 in contact with the main cable 200. In particular, the contact part 400 may comprise a metal strip encasing or surrounding the contact segment 310*a* and the main conductor 210 at said contact segment 310*a*.

Figure 8A:
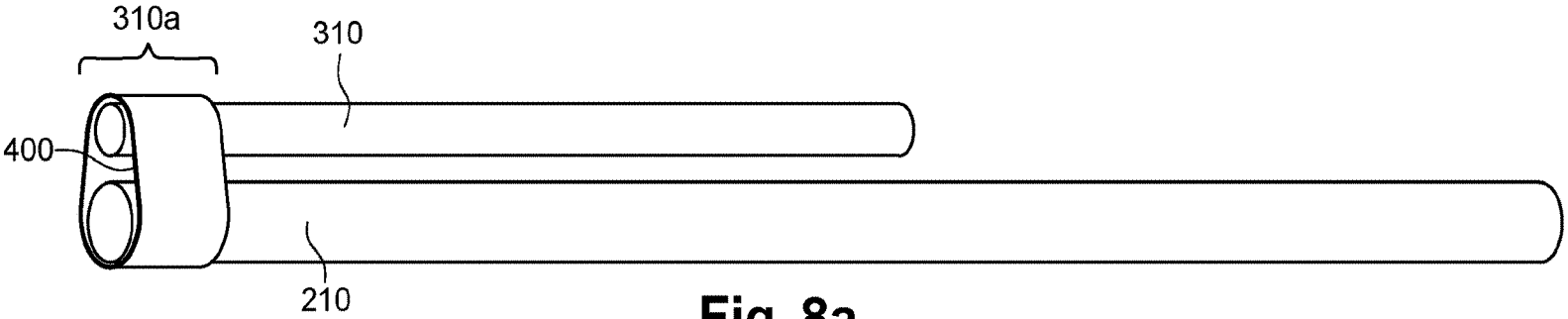
FIG. 8*a* is a first example of an indirect contact via a contact piece between a secondary conductor and the main conductor of a cable according to this invention.

The contact part 400, as shown on FIG. 8*a*, also limits detachment to the section of the stub cables 300 containing the stub segment 310*b*.

Figure 8B:
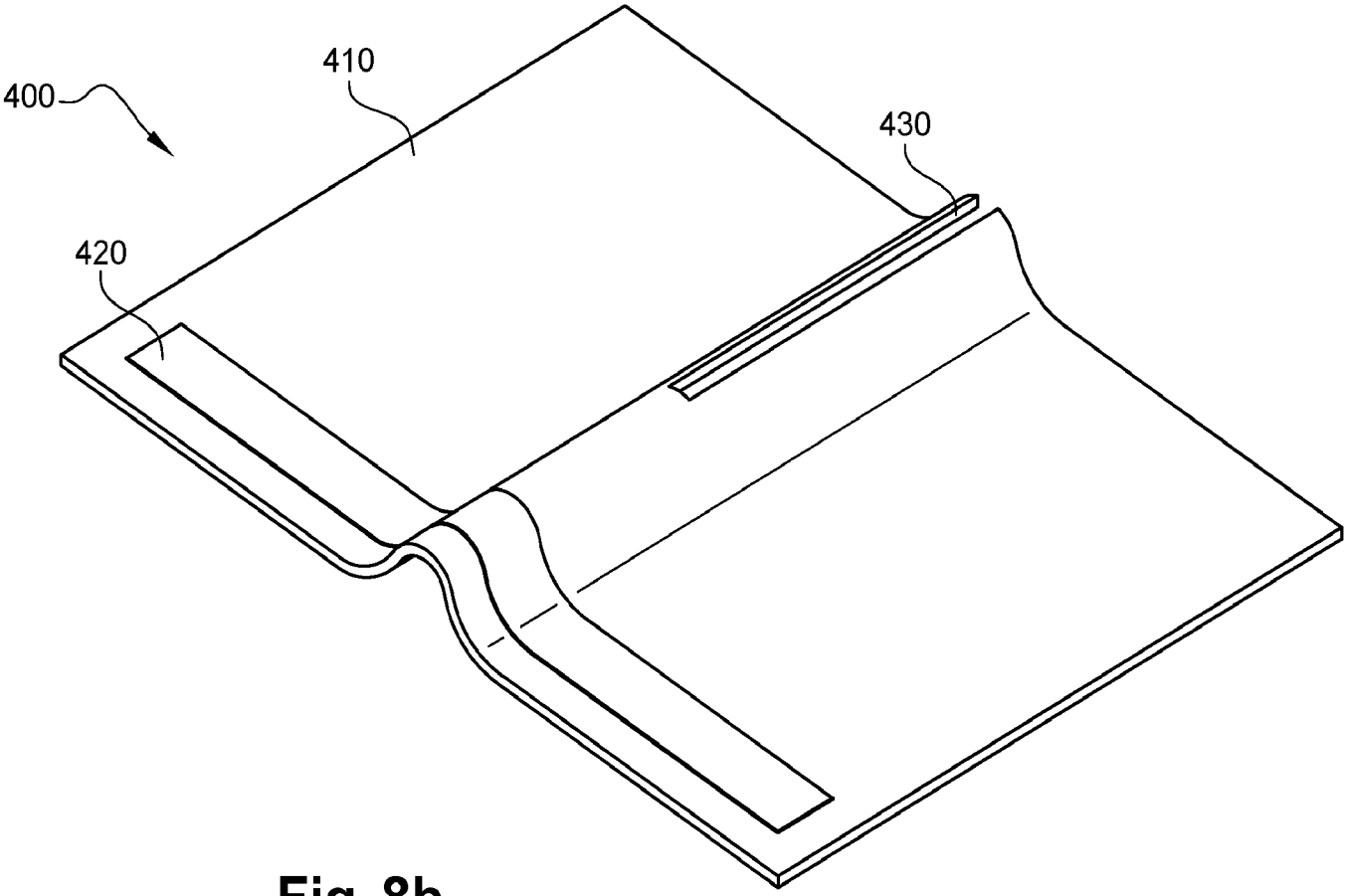
FIG. 8*b* is a representation of a variant of the contact part presented in FIG. 8*a* and that could be used in the context of this invention.

A variant of this contact part is also presented in FIG. 8*b*. According to this variant, the contact part may be made of a flexible electrically insulating material 410, for example a polymer or a fabric, that will be wound around the main conductor and the secondary conductor. Also according to this variant, the flexible contact part is also provided with a metal strip 420 that will make electrical contact between the main conductor and the secondary conductor. The flexible material 410 may also comprise a slot 430.

Figure 12A:
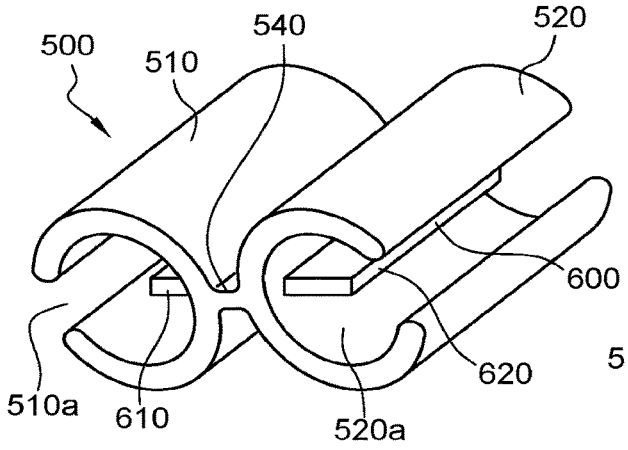
FIGS. 12*a* and 12*b* are diagrammatic representations of a connector according to a first embodiment of said connector.
Figure 12B:
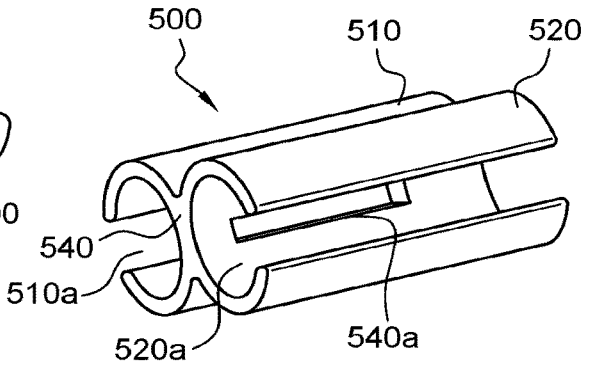

Alternatively, the contact part 400 may be in the form of a mechanical reinforcement (FIG. 9) that extends along the contact segment 310*a*. The contact part forms a connector 500 provided with a connecting element 505 that comprises a main part 510 and a secondary part 520 defining a main channel 510*a* and a parallel secondary channel 520*a* respectively, separated by a central section 540 (FIGS. 12*a* and 12*b*).

Advantageously, the main part 510 and/or the secondary part 520 is/are tubular in shape.

In particular, the secondary channel 520*a* is adapted to house the contact segment 310*a* by partial or total encasing of this segment.

The main channel 510*a*, advantageously with an extension less than or equal to the extension of the secondary channel 520*a*, is adapted to house a section of the main conductor 210, called the main contact segment 210*a*, by partial or total encasing of it.

The connecting element 505 may be single-piece.

"Single-piece connecting element" means a connecting element made from a single part.

Figure 24A:
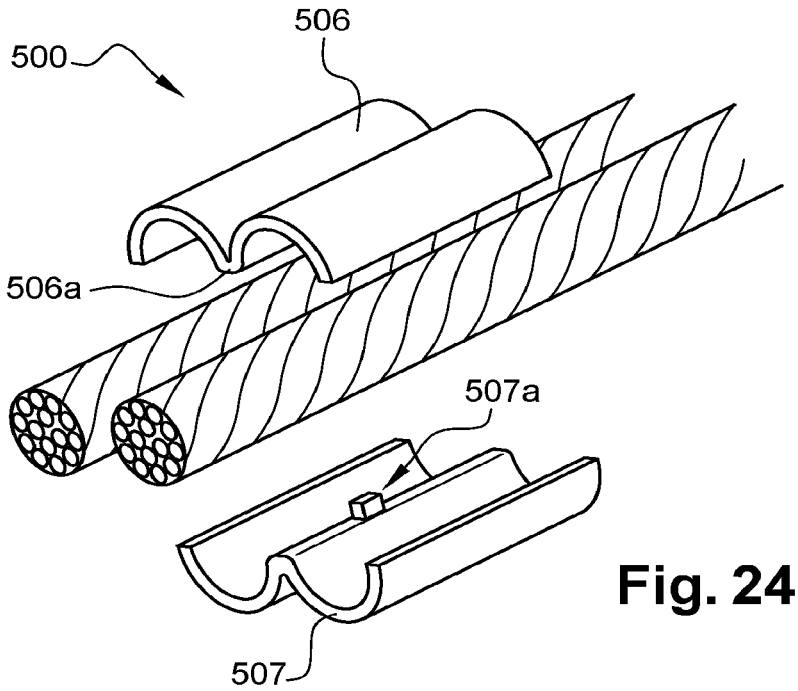
FIGS. 24*a* and 24*b* are diagrammatic representations of a connector comprising an assembly of an upper section and a lower section.
Figure 24B:
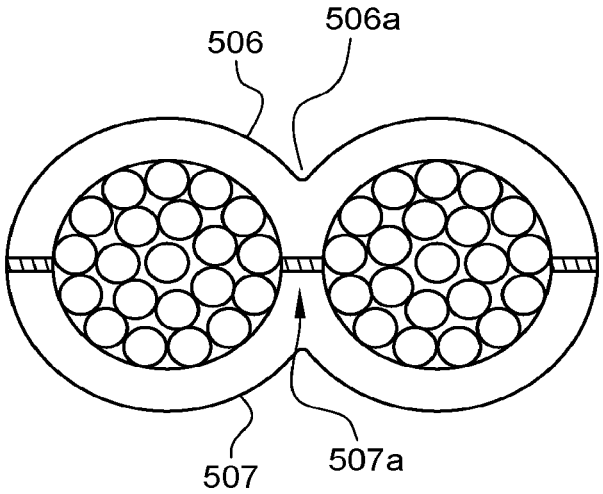

Alternatively and as illustrated in FIGS. 24*a* and 24*b*, the connecting element 505 may be an assembly of an upper section 506 and a lower section 507 assembled at their central section, called the upper central section 506*a* and the lower central section 507*a* respectively.

In particular, the upper section 506 and the lower section 507 are essentially symmetric to each other about a plane containing the elongation axes of the main channel 510*a* and the secondary channel 520*a*.

The lateral edges of each of the upper section 506 and lower section 507 may also be joined together.

The upper section 506 and lower section 507 are assembled by pressing these two sections in contact with each other at high temperature so as to hold them welded together.

Before the upper section 506 and the lower section 507 are assembled, the connection means may be housed in one of these two sections, and particularly at either the upper central section 506*a* or the lower central section 507*a*.

The connecting element 505 may include an electrically conducting material, for example copper or aluminium.

The connector 500 may also comprise connection means 600 made of an electrically conducting material, designed to electrically connect the main conductor 210 and the secondary conductor 310 as soon as they are housed in the main channel 510*a* and the secondary channel 520*a* respectively. In this case, the connecting element 505 may include an electrically insulating material, for example a polymer.

In particular, the electrical connection means 600 may include a main contact section 610 and a secondary contact section 620 emerging in the main channel 510*a* and in the secondary channel 520*a* respectively, and connected through an intermediate section 630 (FIGS. 12*a*, 13, 14, 15*a* and 15*b*).

The electrical connection means may in particular include a fuse function, for example at the intermediate section 630. This fuse function is particularly useful if the sections of the secondary conductors are much smaller than the main conductor, in other words they have a much lower resistance to current.

"Fuse function" refers to a means that melts before the current passing through said means exceeds a threshold. Consequently, connection means that perform a fuse function according to the meaning used in this invention, is a means that melts before the secondary conductors and the main conductor, as soon as the current intensity exceeds a given threshold.

An expert in the subject will be capable of designing this fuse function and, making use of his general knowledge alone, will be able to implement said function, particularly by reducing the section of connection means, and more particularly the section of the intermediate section 630.

For example, the secondary channel 520*a* can be arranged to house a secondary conductor 310 adapted to cause circulation of a current less than a predetermined current, and connection means may be adopted to melt as soon as the current passing through them exceeds the predetermined current by 40%, to perform the fuse function.

According to a first embodiment, the intermediate section 630 may pass through the central section 540 at a communicating passage 540*a* between the main channel 510*a* and the secondary channel 520*a* (FIG. 12*a*).

The communicating passage 540*a* may advantageously be open at one end of the central section 540. Thus, as illustrated in FIG. 13, the electrical connection means 600 may be installed in the connecting element 505 by sliding said connector 500 along the longitudinal direction.

The main contact section 610 and the secondary contact section 620 can each form an elongated protuberance (FIG. 12*a*) or a protuberance in the form of a stud, or with a pointed shape (FIG. 9).

Figure 13:
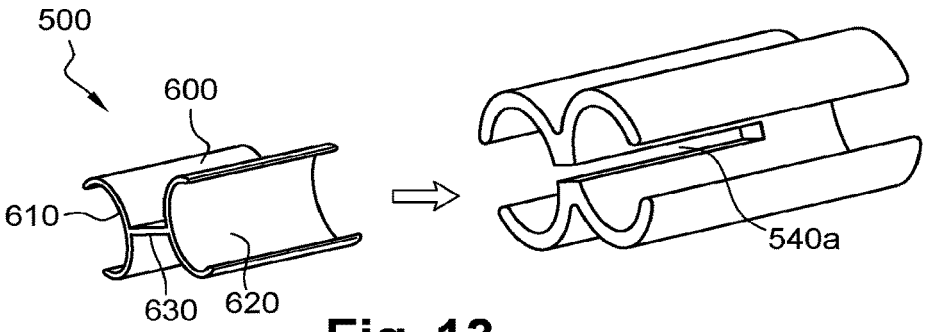
FIG. 13 is a diagrammatic representation of a variant of the first embodiment of the connector.
Figure 14:
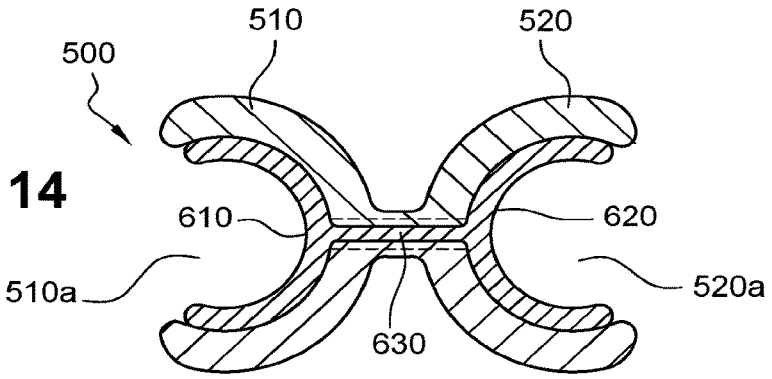
FIG. 14 is a diagrammatic representation of the connector according to the first embodiment, in a section plane.

Alternatively, the main contact section 610 and/or the secondary contact section 620 may have shapes complementary to the surface defining the main channel 510, and the surface defining the secondary channel 520, respectively (FIGS. 13 and 14).

"Complementary shape" means a main or secondary contact section that at least partly matches the internal surface of the channel in which it is located.

Figure 15A:
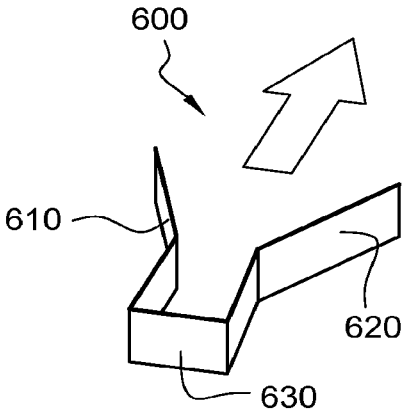
FIGS. 15*a* and 15*b* are diagrammatic representations of the connector according to a second embodiment, and in particular
Figure 15B:
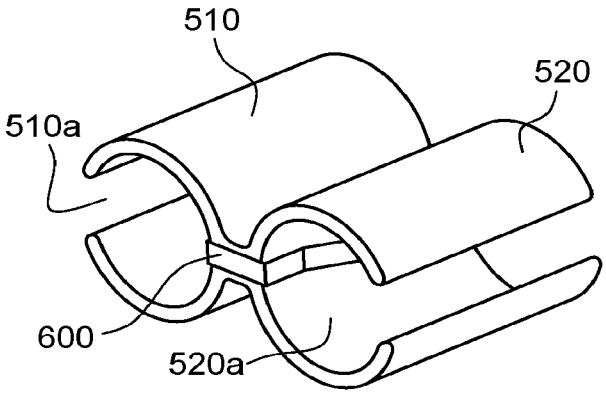

According to a second embodiment illustrated in FIGS. 15*a* and 15*b*, the intermediate section 630 may comprise a clip 630*a* to perform the function of holding the electrical connection means at the central section 540.

It is understood that the main contact section 610 and the secondary contact section 620 used in the first embodiment may also be used in this second embodiment.

Figure 16A:
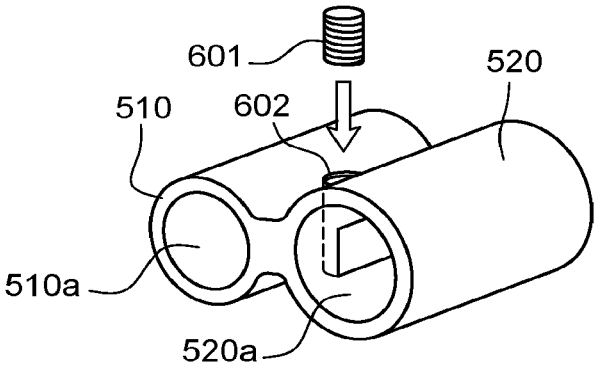
FIGS. 16*a* and 16*b* are diagrammatic representations of the connector according to a third embodiment.
Figure 16B:
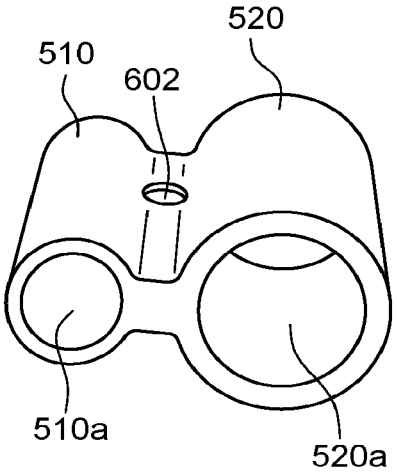

According to a third embodiment illustrated in FIGS. 16*a* and 16*b*, the electrical connection means 600 may include a screw 601, and particularly a set screw.

In particular, the screw 601 can be tightened at a drilling 602 formed in the central section 540. The drilling 602 is arranged particularly to form an opening in each of the two main 510*a* and secondary 520*a* channels. In other words, the drilling 602 has two lateral openings into each of the main channel 510*a* and the secondary channel 520*a*, exposing the thread of the screw 601. In other words, the thread of the screw 601 is designed to provide electrical contact with the contact segment 310*a* and with the main contact segment 210*a*.

This embodiment is also particularly advantageous because the thread of the screw 601 tightens the main contact segment 210*a* in the main channel 510*a* and the contact segment 310*a* in the secondary channel 520*a*.

Regardless of which embodiment is envisaged, the main channel 510*a* may include a lateral slit along its entire length, so that the main contact section 210*a* can be inserted in the main channel 510*a* by a snap fit (FIGS. 12*a*, 12*b* and 13).

Equivalently, the secondary channel 520*a* may include a lateral slit along its entire length, so that the contact section 310*a* can be inserted in the secondary channel 310*a* by a snap fit (FIGS. 12*a*, 12*b* and 13).

Particularly advantageously, the secondary channel 520*a* may comprise a stop called the secondary stop 521 that will prevent a secondary conductor from passing through the secondary channel completely.

According to a first variant, the secondary step may be placed at the end of the secondary channel.

According to a second variant, the secondary step may separate the secondary channel into a first volume 522*a* and a second volume 522*b*, for example the secondary contact section 520*b* emerging in the first volume 522*a*.

According to this second variant, the connector 500 may then advantageously be used to hold two successive secondary conductors 310 in a row of stub cables 300, and called the upstream conductor and the downstream conductor respectively. More particularly, the contact segment 310*a* of the downstream conductor may be inserted in the first volume 522*a* so as to be in electrical contact with the main conductor 210 at the connector considered, while the end of the stub segment 310*b* of the upstream conductor is inserted in the second volume 522*b*. It is also understood that in this configuration, the secondary contact section emerges only in the first volume.

Thus, the stop can help to insulate the downstream conductor from the upstream conductor, and particularly any electrical contact between said downstream and upstream conductors in the connector 500.

Furthermore, this secondary stop makes it possible to hold each secondary conductor 310 at its ends in the connector. This aspect is particularly advantageous when the method used to manufacture a multi-strand cable involves an extrusion step as described in the remainder of the disclosure with reference to FIGS. 20*a* to 23.

It is also worth noting that holding two successive secondary conductors 310 in a row of stub cables 300 can also be envisaged with a connector 500 that does not have a secondary stop 521.

Figure 17A:
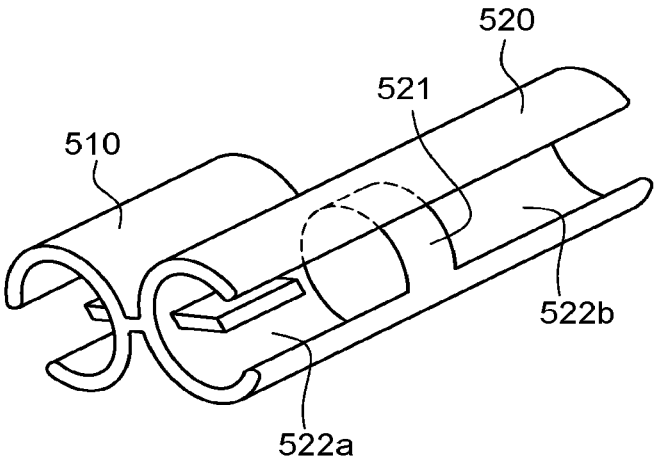
FIGS. 17*a* to 17*c* are diagrammatic representations of a connector provided with a secondary stop.

According to a first alternative, the secondary stop 521 may be in the form of at least one plug obstructing the passage in the secondary channel 510*a* (FIG. 17*a*).

Figure 17B:
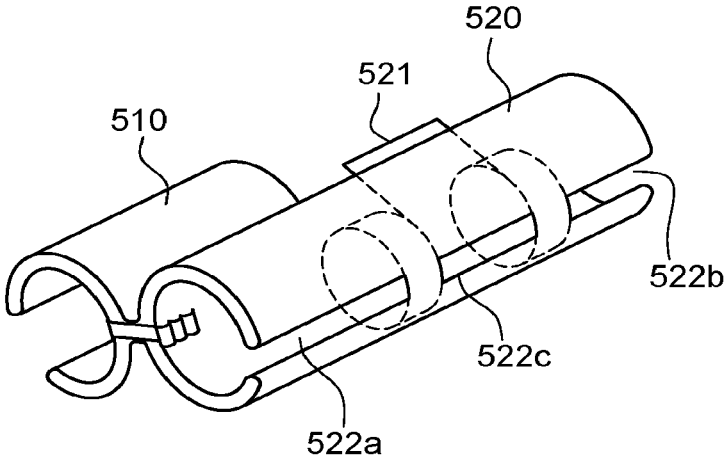

According to a second alternative, the secondary stop 521 can be in the form of two plugs creating an intermediate volume 522*c* between the first volume 522*a* and the second volume 522*b* (FIG. 17*b*). A cut at this intermediate volume 522*c* to initiate detachment of the stub segment 310*b* does not affect the electrical insulation of the upstream and downstream conductors.

Figure 17C:
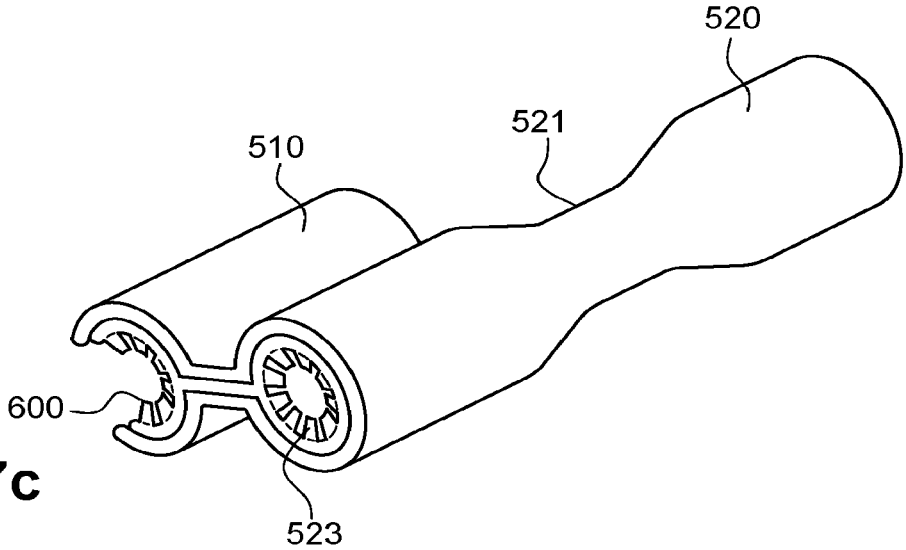

According to a third alternative, the secondary part is tubular in shape and comprises a contraction zone forming the secondary stop 521. The contraction zone forms an intermediate volume 522*c* interposed between the first volume 522*a* and the second volume 522*b*, in the same way as the two plugs in the second alternative (FIG. 17*c*). This third alternative is particularly advantageous in that the contraction zone is the location of a mechanical weakness that can facilitate detachment of a stub cable. In other words, the contraction zone can advantageously be made to correspond to a pre-weakened termination 330 of the multi-conductor electrical cable so as to facilitate detachment of the stub cable 300.

Particularly advantageously, the connector 500 may be provided with anchor means 523 designed to hold the secondary conductor 310 in a locked position. The anchor means 523 prevent separation of the secondary conductor 310 from the multi-conductor electrical cable 100, during detachment of a stub cable 300.

In particular, the anchor means 523 may comprise projecting elements 523*a* designed to grip the secondary conductor.

Figure 18A:
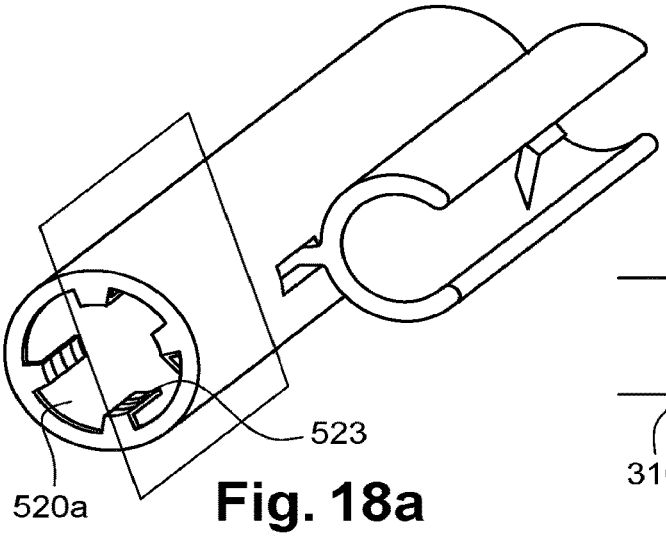
FIGS. 18*a* and 18*b* are two diagrammatic representations, in perspective and sectional views respectively, of a connector provided with anchor means in the form of projecting elements arranged on the internal surface of the secondary channel.
Figure 18B:
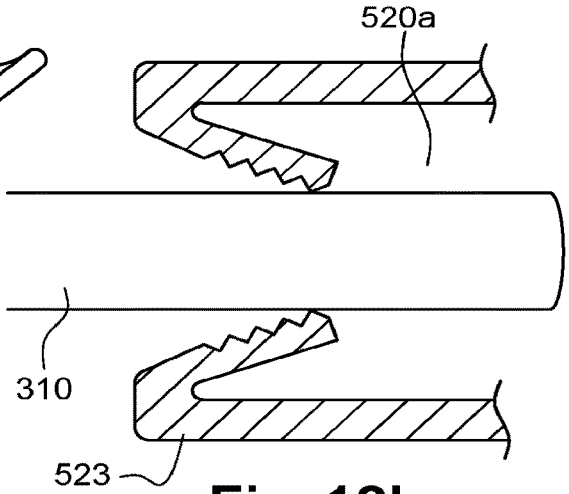
Figure 19:
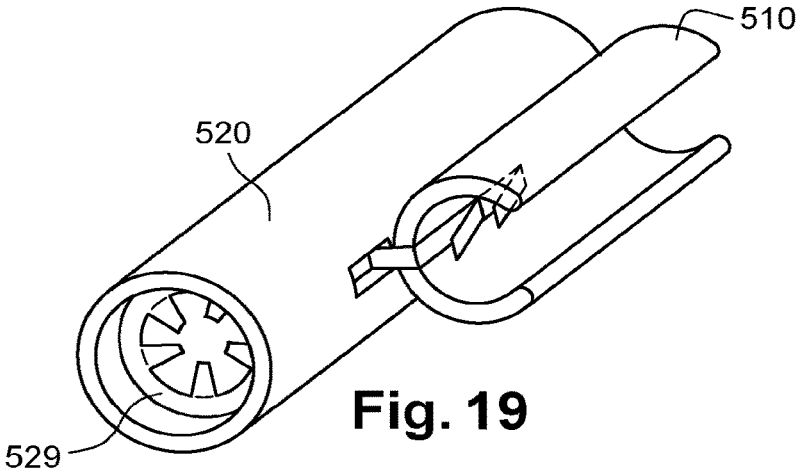
FIG. 19 is a diagrammatic representation of a connector provided with anchor means in the form of a ring fitted with claws and inserted in the secondary channel.

The projecting elements 523*a* can be arranged on the internal surface of the secondary channel 520*a* (FIGS. 18*a* and 18*b*). Alternatively, as illustrated on FIG. 19, the projecting elements can be arranged on a ring 529 with a shape complementary to the secondary channel 520*a* and inserted in said channel.

According to another alternative (FIG. 17*c*), the anchor means 523 may form an integral part of the electrical connection means 600 and in particular can be arranged on the secondary contact section 620.

Figure 20A:
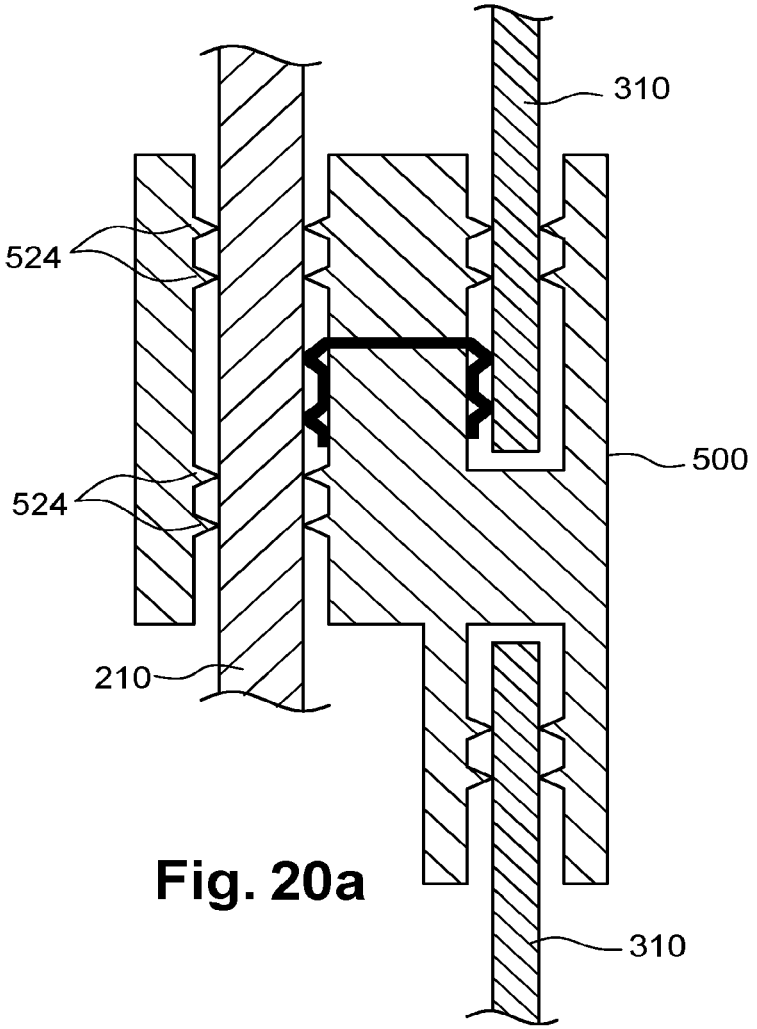
FIGS. 20*a* and 20*b* are diagrammatic representations of how the main conductor and secondary conductors are held by the connectors.
Figure 20B:
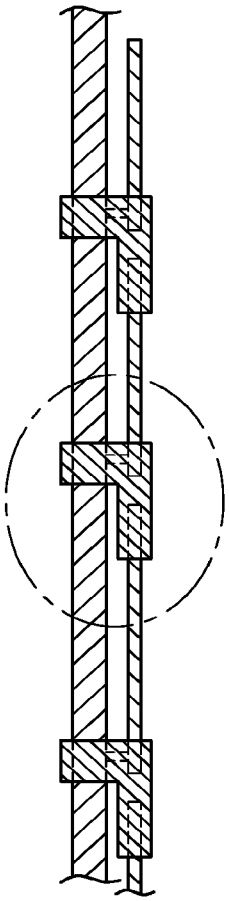

Complementarily, the main channel 510*a* may comprise protuberances called principal protuberances 524 on its internal surface, that will guide the main conductor 210 (FIG. 20*a*).

The installation of the multi-conductor electrical cable 100 without any connectors 500 as described above, is illustrated on FIGS. 21*a* to 21*c*.

Figure 21A:
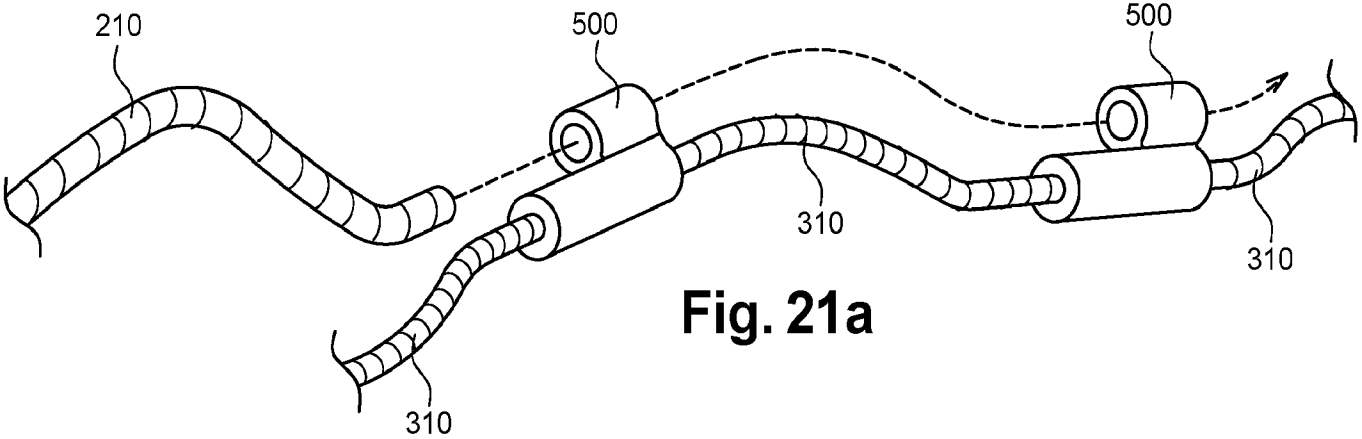
FIGS. 21*a* and 21*b* are diagrammatic representations of steps in the assembly of the main conductor, secondary conductors and single-piece connectors.

In particular, FIG. 21*a* represents the assembly of secondary conductors 310 with connectors 500, and particularly connectors for which the secondary channel 520*a* is provided with a secondary stop 521.

Figure 21B:
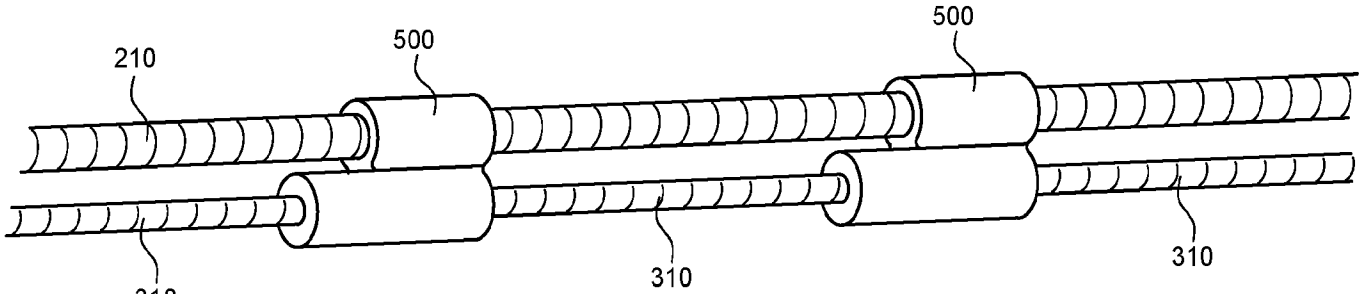
Figure 21C:
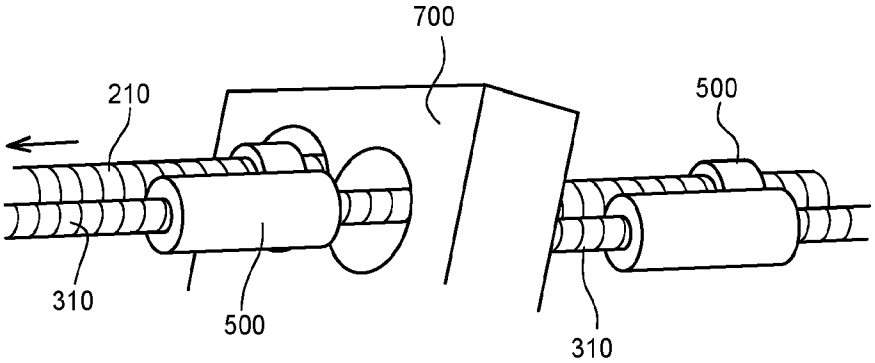
FIG. 21*c* represents the passage of the assembly presented in FIG. 21*b* in an extrusion die, ready for this assembly to be coated by an insulating sheath.

This step is then followed by the installation of the main conductor 210 in the main channels 510*a* of the connectors 500 (FIG. 21*b*).

Passage of this assembly in an extrusion die 700 (FIG. 21*c*) can then form the encasing sheath 220 around the main conductor 210, the secondary conductors 310 and the connectors 500.

FIGS. 22*a* to 22*c* and 23 illustrate detachment of a stub cable 300 from the multi-conductor electrical cable 100.

Figure 22A:
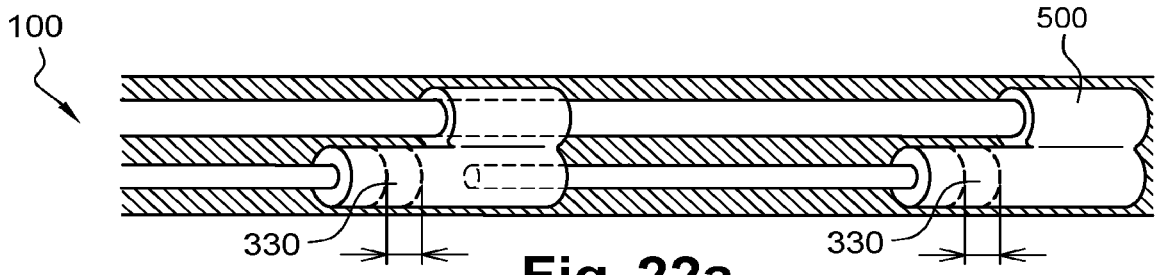
FIGS. 22*a* to 22*c* and 23 are diagrammatic representations of steps involving detachment of a stub cable from the multi-conductor electrical cable.
Figure 22B:
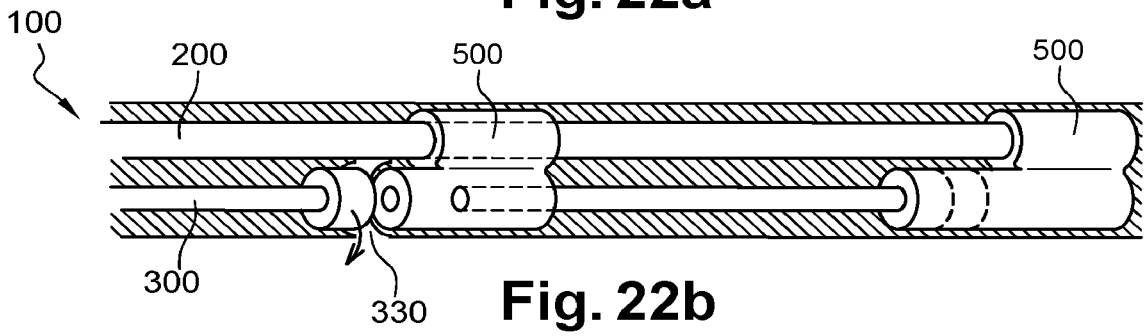

In particular, FIGS. 22*a* and 22*b* represent the cut of the termination 330. The termination may be pre-weakened and, in this case, a simple tearing force should be sufficient to initiate detachment of the stub cable. Otherwise, for example in the presence of a core common to all secondary conductors or in the presence of a connector 500 that has a contraction zone separating the first volume and the second volume, it may be necessary to cut the termination 330 using a pair of cutters 800 like those illustrated in FIG. 23.

Figure 22C:
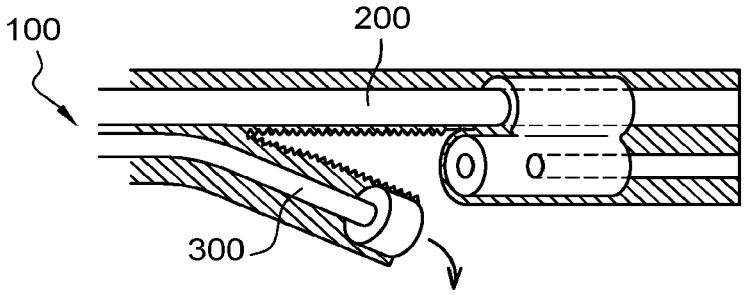

Cutting is then followed by detachment of the stub cable 300 at the insulation section 110 (FIG. 22*c*). The cut stops naturally at the connector 500 that has higher resistance to tearing.

This invention also relates to an assembly of multi-conductor electrical cables 100 (FIG. 10).

In particular, the assembly comprises a plurality of multi-conductor electrical cables 100 comprising a common encasing sheath, and electrically insulated from each other by said common casing.

The assembly may be flat (FIG. 11*a*) or in star formation (FIG. 11*b*).

The multi-conductor electrical cable and/or the assembly, without any branches and with a relatively constant section, can advantageously be used to make electrical connections in congested spaces.

Their ease of use limits manipulations and facilitates the electrical connection of electrical equipment, particularly for the distribution of energy in buildings.

A multi-conductor electrical cable according to this invention is also advantageously used for electrical distribution, particularly for external networks requiring leak tight connections at reasonable cost or with reasonable difficulty.

These cables can also be used for electrical connection of solar panels or wind turbines.

REFERENCES

[1] CN201750032 U

The invention claimed is:

1. A connector made of an electrically insulating material configured to electrically connect a main conductor and a secondary conductor, the connector comprising a connection device that comprises:

a central section extending along a longitudinal direction, said central section being made of said electrically insulating material;

a main part and a secondary part defining a main channel and a secondary channel respectively, parallel to the longitudinal direction and separated by the central section, wherein said main part and said secondary part are made of said electrically insulating material;

the connector comprises electrical connection means made of an electrically conducting material, configured to electrically connect along said longitudinal direction the main conductor and the secondary conductor as soon as they are inserted in the main channel and in the secondary channel respectively.

2. The connector according to claim 1, wherein the electrical connection means comprise a main contact section and a secondary contact section emerging in the main channel and in the secondary channel respectively, and connected by an intermediate section.

3. The connector according to claim 2, wherein the intermediate section passes through the central section at a passage communicating between the main channel and the secondary channel.

4. The connector according to claim 3, wherein the communicating passage is also open at one end of the central section to enable assembly of electrical connection means and the connecting element, by sliding along the longitudinal direction.

5. The connector according to claim 2, wherein each of the main contact section and the secondary contact section forms an elongated or tenon shaped or pointed protuberance.

6. The connector according to claim 2, wherein the main contact section and/or the secondary contact section have shapes complementary to a surface defining the main channel, and a surface defining the secondary channel, respectively.

7. The connector according to claim 2, wherein the intermediate section comprises a clip that performs the function of holding the electrical connection means at the central section.

8. The connector according to claim 1, wherein the electrical connection means comprise a screw, particularly a setscrew.

9. The connector according to claim 8, wherein the connection device comprises a drilling at the central section arranged such that a screw thread opens up in the main channel and the secondary channel, and is used to tighten the main conductor and the secondary conductor respectively.

10. The connector according to claim 1, wherein the main channel and/or the secondary channel comprise(s) a lateral slit over its entire length.

11. The connector according to claim 1, wherein, the secondary channel comprises a stop called a secondary stop that will prevent a secondary conductor from passing through the secondary channel completely.

12. The connector according to claim 11, wherein the secondary stop separates a volume of the secondary channel into a first volume and a second volume.

13. The connector according to claim 12, wherein the secondary contact section emerges only in one or the other of the first and second volumes.

14. The connector according to claim 12, wherein the secondary part is tubular in shape and comprises a contraction zone forming the secondary stop.

15. The connector according to claim 14, wherein the main part is tubular in shape.

16. The connector according to claim 2, wherein the secondary channel is provided with anchor means designed to hold the secondary conductor in a locked position.

17. The connector according to claim 16, wherein the anchor means comprise projecting elements that will grip the secondary conductor.

18. The connector according to claim 1, wherein the connecting device is a single-piece.

19. The connector according to claim 1, wherein the connecting device is an assembly of an upper section and a lower section called the upper central section and the lower central section respectively, and assembled at their central sections.

20. The connector according to claim 19, wherein the upper section and the lower section are essentially symmetric to each other about a plane containing the elongation axes of the main channel and the secondary channel.

21. The connector according to claim 1, wherein the connection means include a fuse function.

22. A multi-strand cable extending along a length, called the principal length Lp, and including:

a main cable extending over the principal length Lp, and stub cables distributed along the main cable, the main cable comprises a main conductor, encased by an encasing sheath, each stub cable comprises a secondary conductor embedded in the encasing sheath and held fixed to and advantageously parallel to the main cable, along its entire length, each secondary conductor is provided with a contact segment connected to the main conductor and a stub segment, the stub segment being insulated from the main conductor by a section called the insulating section of the encasing sheath, the electric connection between the main conductor and the contact segment being made with a connector comprising:

a central section extending along a longitudinal direction;

a main part and a secondary part defining a main channel and a secondary channel respectively, parallel to the longitudinal direction and separated by the central section;

the connector comprises electrical connection means made of an electrically conducting material, configured to electrically connect the main conductor and the secondary conductor as soon as they are inserted in the main channel and in the secondary channel respectively.

* * * * *